United States Patent [19]

Oka

[11] Patent Number: 4,627,716

[45] Date of Patent: Dec. 9, 1986

[54] TONER HANDLING APPARATUS FOR ELECTRO-PHOTOGRAPHIC COPYING MACHINES

[75] Inventor: Tateki Oka, Toyohashi, Japan

[73] Assignee: Minolta Camera Kabushiki Kaisha, Osaka, Japan

[21] Appl. No.: 638,716

[22] Filed: Aug. 8, 1984

[30] Foreign Application Priority Data

Aug. 12, 1983 [JP] Japan ..... 58-125940[U]
Aug. 12, 1983 [JP] Japan ..... 58-125941[U]

[51] Int. Cl.[4] ..... G03G 21/00
[52] U.S. Cl. ..... 355/15; 355/3 DD
[58] Field of Search ..... 355/3 DD, 15; 118/653; 430/125; 215/232, 233; 220/201, 359, 361

[56] References Cited

U.S. PATENT DOCUMENTS 3,985,436 10/1976 Tanaka et al. ..... 355/15 X
4,001,928 1/1977 Schweiso ..... 220/201 X
4,376,578 3/1983 Tanaka et al. ..... 355/15
4,500,196 2/1985 Shimura ..... 355/3 DD
4,501,484 2/1985 Shimura ..... 355/15
4,522,487 6/1985 Misawa ..... 355/15

FOREIGN PATENT DOCUMENTS 54-29378 9/1979 Japan .
55-153969 12/1980 Japan .

*Primary Examiner*—A. T. Grimley
*Assistant Examiner*—C. Romano
*Attorney, Agent, or Firm*—Wenderoth, Lind & Ponack

[57] ABSTRACT

A toner handling apparatus for use in transfer-type electrophotographic copying machines, such as a toner collecting container for accommodating the toner collected from a photoconductive member by a cleaner, or an image forming unit which includes the photoconductive member and a copying element (developing device and/or cleaner) disposed around the photoconductive member and adapted to accommodate a developer therein and which is removably installable in its entirety in the main body of the copying machine, which is provided in its opening with a thermally expandable resin and a heater for expanding the resin. The resin, which is unexpanded, expands to a thickness several times to several tens of times as large as the original thickness when heated to the expanding temperature and becomes adhesive upon expansion. When the resin is heated by the heater the opening of the toner handling apparatus is sealed off, whereby the toner handling apparatus can be replaced by a new one, without permitting scattering of the toner through its opening.

19 Claims, 9 Drawing Figures

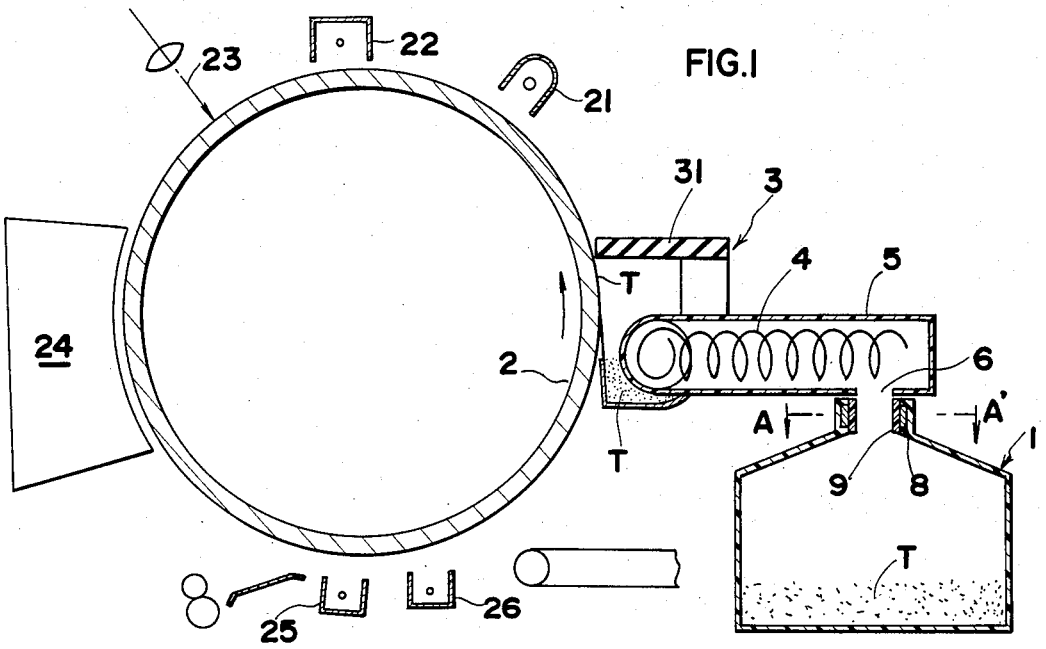
FIG.1
FIG.2
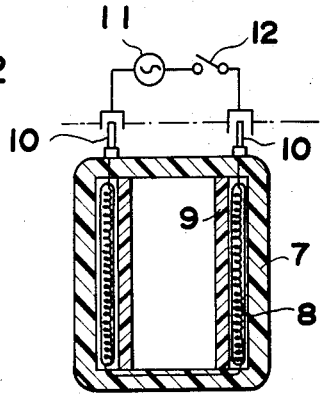
FIG.3
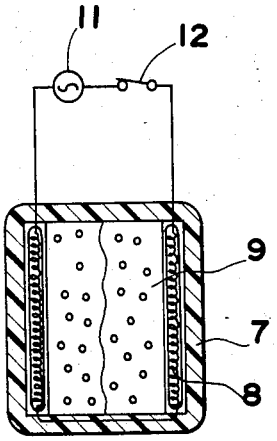
FIG.4
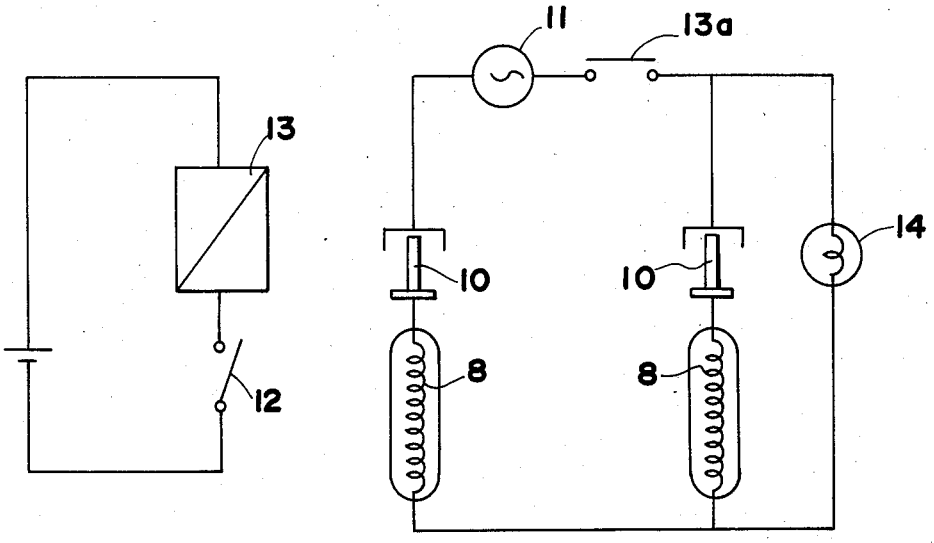

TONER HANDLING APPARATUS FOR ELECTRO-PHOTOGRAPHIC COPYING MACHINES

BACKGROUND OF THE INVENTION

The present invention relates to a toner handling apparatus for use in transfer-type electrophotographic copying machines, such as a toner collecting container for accommodating the toner collected from the photoconductive drum by a cleaner, or an image forming unit which comprises a photoconductive drum and a developing device and/or a cleaner provided around the drum as assembled therewith and which is removably installable in the main body of the copying machine.

Electrophotographic copying machines of the transfer type are provided with a cleaner for collecting the residual toner which has not been transferred to copy paper in order to repeatedly use the photoconductive drum. The toner collected by the cleaner contains particles of copy paper, fragments of the material forming the photosensitive layer of the photoconductive drum, etc., while the toner itself sometimes remains charged by the transfer charger to a polarity unsuited to the formation of copy images. If recycled to the developing device for reuse, such collected toner produces smudged copies and is therefore not normally recycled but rather is collected in a container for disposal.

However, when the container is removed to discard the collected toner, toner particles are likely to escape from the container to stain the interior of the copying machine and the hands of the operator.

On the other hand, U.S. Pat. No. 3,985,436 recently proposes an electrophotographic copying machine in which the photoconductive drum, and the developing device, cleaner and other elements arranged around the drum for forming images are assembled into an image forming unit which is removably installed in the machine main body to assure easy maintenance and efficient repairs. With this copying machine, the image forming unit needs only to be replaced during the periodic maintenance and inspection of the elements around the photoconductive drum and for repairs thereof. This greatly reduces the period of time during which the user is unable to use the copying machine and also assures an improved service efficiency because the serviceman has only to collect the removed image forming unit and discard the unit or make the unit ready for reuse in a service factory.

Nevertheless, since toner is accommodated in the developing device and the cleaner constituting the image forming unit, the toner scatters when the unit is removed to stain the interior of the copying machine, the neighborhood thereof, the garment of the operator, etc.

To solve the above problem, Published Examined Japanese Patent Application SHO No. 54-29378 proposes a cleaner which is internally provided with specific heating means for melting the collected toner, but the proposed cleaner has the drawback that the heating means, which is disposed in the vicinity of the photoconductive member, adversely affects the photoconductive member with heat and requires much power consumption.

SUMMARY OF THE INVENTION

The main object of the present invention which has been accomplished in view of the foregoing problems is to provide a toner collecting container or an image forming unit which is removable with toner contained therein, without permitting scattering of the toner through its opening.

More specifically the invention provides a toner collecting container for accommodating the toner collected from a photoconductive member by a cleaner, the container being characterized in that it is provided in the interior of its opening with a thermally expandable resin and heating means for expanding the resin.

The invention further provides an image forming unit which includes a photoconductive member and a copying element (developing device and/or cleaner) disposed around the photoconductive member and adapted to accommodate a developer therein and which is removably installable in its entirety in the main body of a copying machine, the image forming unit being characterized in that the copying element has a casing opening opposed to the photoconductive member and provided with a thermally expandable resin and heating means for expanding the resin.

BRIEF DESCRIPTION OF THE DRAWINGS

FIG. 1 is a fragmentary view in section schematically showing a copying machine which is provided with a toner collecting container embodying the invention;

FIG. 2 is a view in section taken along the line A–A' in FIG. 1 and showing the toner collecting container;

FIG. 3 is a sectional view showing the toner collecting container with its opening sealed off by expanding a thermally expandable resin;

FIG. 4 is a diagram of a heater control circuit including timer means;

DETAILED DESCRIPTION OF THE INVENTION

Figure 5:
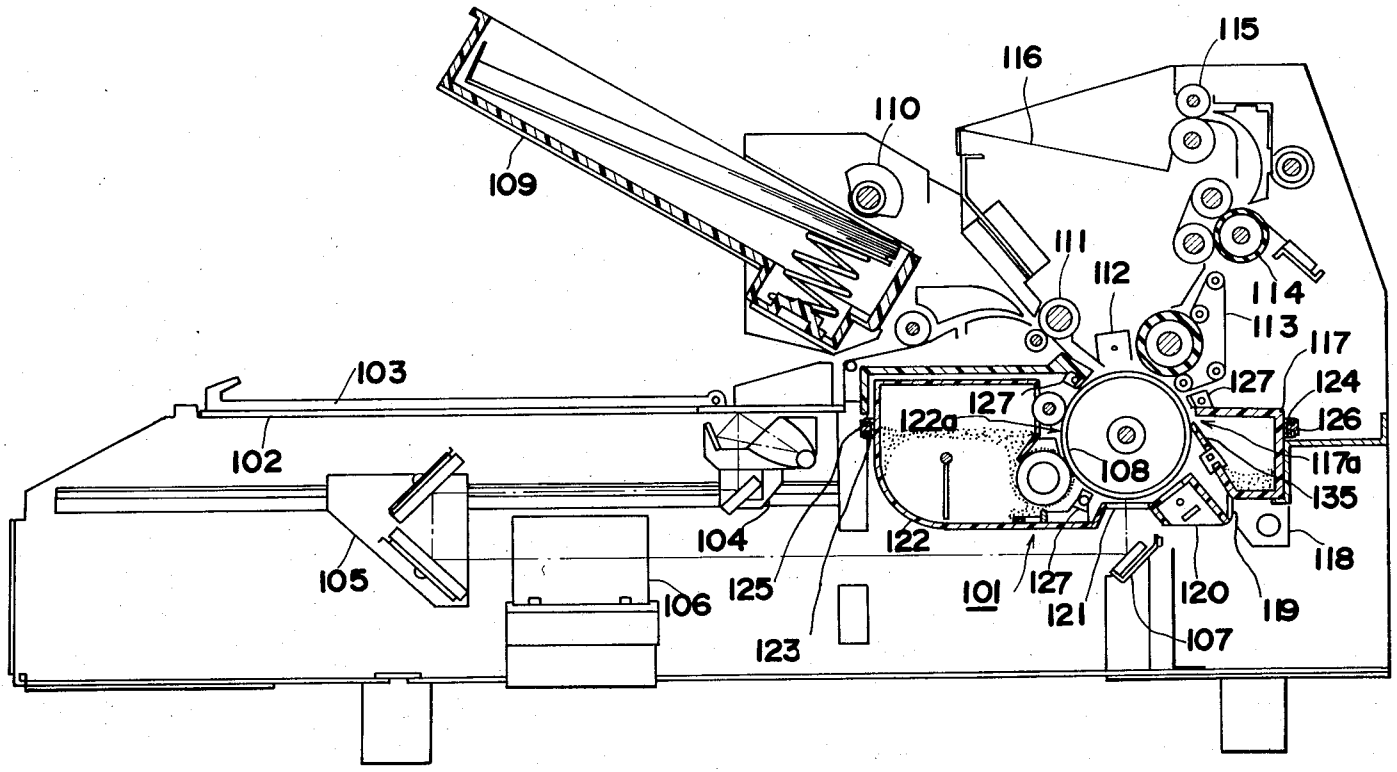
FIG. 5 is a sectional view schematically showing the construction of a copying machine which is equipped with an image forming unit embodying the invention.

FIG. 1 shows primary components of a copying machine provided with a toner collecting container 1 according to the invention. Indicated at 2 is a photoconductive drum which is rotatable in the direction of arrow shown. Arranged around the drum 2 are an eraser lamp 21, sensitizing charger 22, image exposure station 23, developing device 24, transfer charger 25, separating charger 26 and cleaner 3 in succession. The operation of these components is well known and will not be described, while the parts relating to the invention will be described below.

The toner T remaining on the drum 2 is scraped off by a cleaning blade 31, falls into the cleaner 3 and is then transported through a conveyor pipe 5 having a conveyor coil 4 and accommodated in the toner collecting container 1 which is disposed below an aperture 6 at one end of the pipe 5 and which is made of a heat-resistant resin such as polyamide, polyimide or polyamide imide.

The container 1 has an opening 7 which is generally rectangular as seen in FIG. 2. Each of the opposed longer sides of the opening portion has a heater 8 comprising a tungsten lamp and embedded in the side wall and a sheet of thermally expandable resin 9 adjacent to the heater 8.

The resin sheet, which is unexpanded, expands to a thickness several times to several tens of times as large as the original thickness when heated and becomes adhesive upon expansion. An example of useful thermally expandable resin sheet 9 is an expandable adhesive sheet manufactured by Nittoh Denki Kogyo Co., Ltd., Japan as a commercial product, consisting essentially of polyethylene resin and having a thicknss of 1 mm. This sheet expands about 10 times when heated at about 200° C. for 2 minutes. Accordingly even when the opening 7 of the container 1 is internally provided with the heater 8 and the expandable adhesive sheet 9, the aperture 6 can be designed to have a width of about 20 mm, permitting smooth collection of the toner T.

The heater 8 is connected to a power supply 11 and a switch 12 on the copying machine main body through connectors 10 which are attached to the outer side of the opening portion 7, such that when the switch 12 is turned on, the resin sheet 9 is heated to the expanding temperature. The heater 8 will not adversely affect the photoconductive drum 2 because it is adapted to locally heat the inner side of the opening portion 7 of the container 1 and also because it is a sufficient distance away from the drum 1.

When the container 1 is filled with toner and is to be replaced by a new one, the switch 12 is closed to energize the heater 8, whereupon the thermally expandable resin sheet 9 starts expanding. In the case of the expandable adhesive sheet, the expanding sheet closes the opening 7, as shown in FIG. 3 in about 2 minutes.

The resin 9 exhibits adhering properties on expansion as already stated and completely seals off the opening 7, whereupon the switch 12 is turned off to de-energize the heater 8. The opening 7 thereafter remains sealed off.

Alternatively timer means as shown in FIG. 4 may be used for de-energizing the heater 8 upon completion of expansion. More specifically, the switch 12, when turned on, holds a timer relay 13 energized for about 2 minutes, closing its contact 13*a* to supply current to the heater 8. The heater 8 is de-energized when the relay 13 is de-energized to open the contact 13*a*. Thus current can be passed through the heater 8 for the specified period of time merely by turning on the switch 12. A pilot lamp 14 may be provided to display the energization of the heater 8. When it goes off, the pilot lamp 14 indicates completion of sealing for expedited replacement.

The container 1 sealed off at its opening 7 is replaced by a new one. At this time, the collected toner will not scatter since the opening 7 is sealed off.

FIG. 5 schematically shows the construction of a copying machine equipped with an image forming unit 101 embodying the invention and removably installed in the machine main body. The drawing shows an original support glass plate 102 having an overlying original cover 103 for pressing an original against the plate. Arranged below the glass plate 102 are a first optical system 104 and a second optical system 105 for scanning the original. The scanned image of the original is projected through a projection lens 106 and a stationary third optical system 107 on a photoconductive drum 108 included in the image forming unit 101.

A paper feed casette 109 is disposed in an inclined position above the original support glass plate 102. Successively arranged along the path of transport of copy paper from the cassette 109 are a feed roller 110, register roller 111, transfer charger 112, separating belt assembly 113, fixing unit 114, discharge roller 115 and a discharge tray 116.

Figure 6:
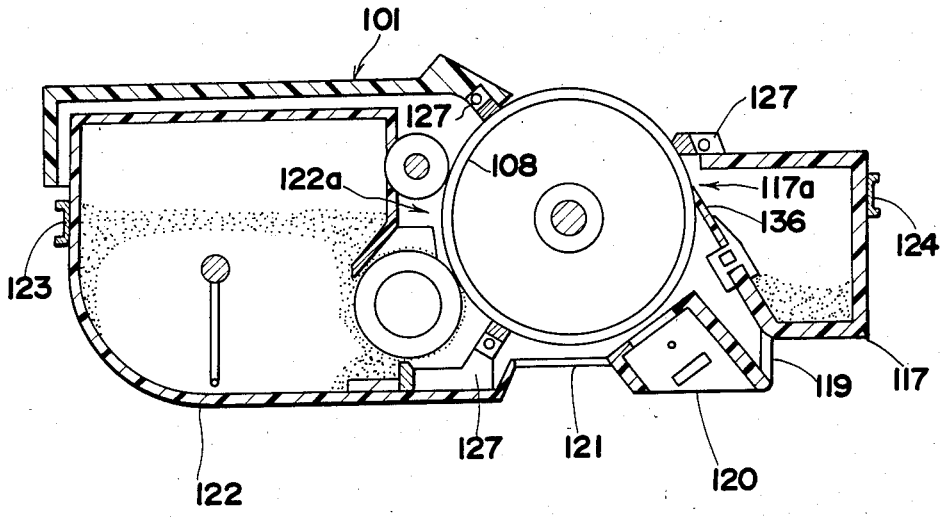
FIG. 6 is a sectional view showing the image forming unit removed from the machine.

The image forming unit 101 generally comprises, arranged around the drum 108, a cleaner 117, eraser slit 119 opposed to an eraser lamp 118, sensitizing charger 120, exposure slit 121 opposed to the third optical system 107, and developing device 122. Guide rails 123, 124 serving as positioning means are fixedly attached to opposite sides of the image forming unit 101, i.e. to the outer sides of the casings of the developing device 122 and the cleaner 117. These rails 123, 124 are respectively engaged with and guided by guide rails 125, 126 mounted on the machine main body, whereby the unit 101 is made removable in its entirety from the machine main body as seen in FIG. 6. The drum 108 is opposed to a casing opening 122*a* of the developing device 122 and to a casing opening 117*a* of the cleaner 117. Sealing devices 127 are provided on the upper and lower portions of the casing opening 122*a* and the upper portion of the casing opening 117*a*.

Figure 7:
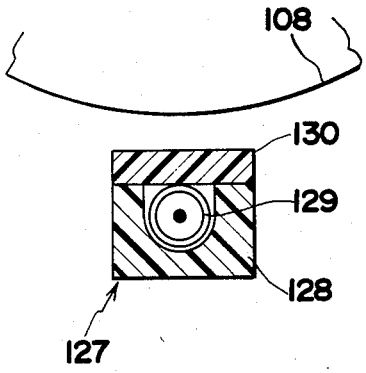
FIG. 7 is a sectional view showing the construction of a sealing device.

As shown in FIG. 7, each of the sealing devices 127 comprises a heater 129 comprising a tungsten lamp and embedded in a heat-resistant base portion 128, and a sheet of thermally expandable resin 130 adjacent to the heater 129 and facing the photoconductive member 108. The base portion 128 has a reflecting surface on its inner side and is made of a metal such as aluminum or a heat-resistant resin such as polyamide, polyimide or polyamide imide.

The resin sheet 130, which is unexpanded, expands to a thickness several times to several tens of times as large as the original thickness when heated and exhibits adhering properties upon expansion. Like the aforementioned resin sheet 9, an example of useful thermally expandable resin sheet 130 is an expandable adhesive sheet manufactured by Nittoh Denki Kogyo Co., Ltd., consisting essentially of polyethylene resin and having a thickness of 1 mm. In this case, the clearance between the adhesive sheet 130 and the drum 108 is set to about 10 mm.

Figure 8A:
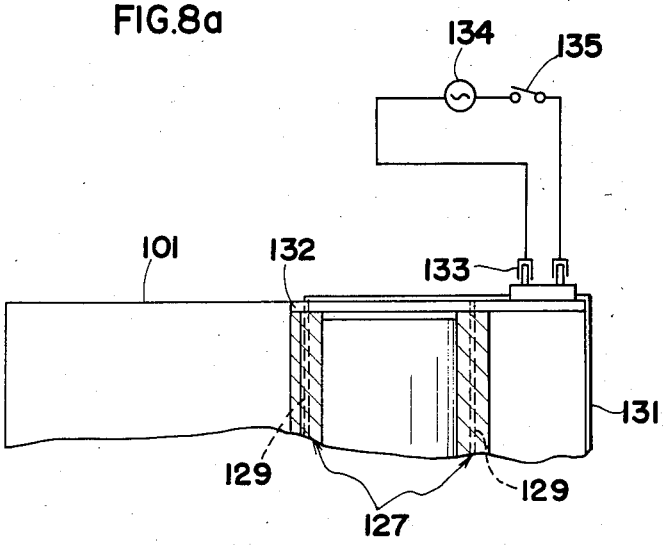
FIGS. 8*a* and 8*b* are diagrammatic views showing the electric connection between the sealing devices of the image forming unit and the power supply of the copying machine.
Figure 8B:
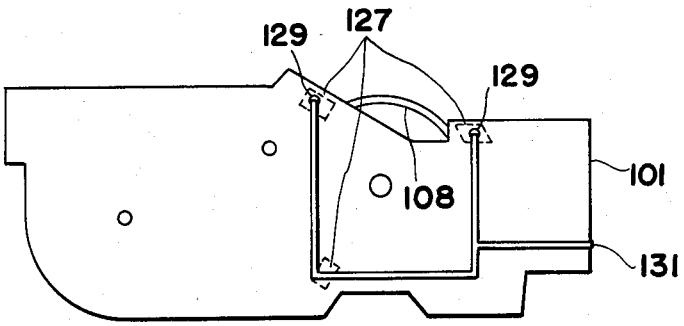

As seen in FIGS. 8*a* and 8*b*, the heaters 129 of the sealing devices 127 are interconnected by a conductor 131 and connected to a power supply 134 and a switch 135 on the machine main body through connectors 133 attached to the outer side of the rear frame 132 of the image forming unit 101. When the switch 135 is turned on, the resin sheets 130 are heated to the expanding temperature (about 200° C.). When the unit 101 is installed in the machine main body by being guided by the guide rails 125 and 126, the connectors 133 are connected to the power supply 134.

When the image forming unit 101 is to be removed from the machine main body, the switch 135 is closed to energize the heaters 129 of the sealing devices 127, whereupon the thermally expandable resin 130 starts expansion. In the case of the above-mentioned expandable adhesive sheet, the clearances between the developing device 122 and the drum 108 are closed, as shown in FIG. 6, in about 2 minutes. The resin 130, which exhibits adhering properties upon expanding as already stated, comes into intimate contact with the drum 108 to completely seal off the interior of the developing device 122 from outside. Even when the switch 130 is then turned off to de-energize the heater 129, the device 122 is held sealed off. Further as in the case of the toner collecting container described with reference to FIG. 4, timer means and a pilot lamp are usable for energizing the heaters 129 to assure expedited removable of the unit.

On the other hand, the resin 130 similarly expands from the cleaner 117 to close the upper clearance between the cleaner 117 and the drum 108. Since a cleaning blade 136 is in pressing contact with the drum 108 at the lower portion of the casing opening 117*a* of the cleaner 117, this portion need not be provided with any sealing device 130.

In this way, the toner accommodating spaces of the developing device 122 and the cleaner 117 are completely sealed off from outside when the image forming unit 101 is to be removed, whereby the toner is prevented from scattering.

As described above, the toner can be reliably prevented from scattering within the copying machine according to the present invention when the toner handling apparatus, such as the toner collecting container and the image forming unit, are to be replaced.

What is claimed is:

1. A toner handling apparatus for use in a transfer-type electrophotographic copying machine comprising an opening in said toner handling apparatus, a thermally expandable resin provided in said opening and heating means for expanding said resin.

2. A toner handling apparatus as claimed in claim 1, wherein said resin expands from an original thickness to a thickness several times to several tens of times as large as the original thickness when heated to an expanding temperature and becomes adhesive upon expansion.

3. A toner handling apparatus as claimed in claim 1, wherein said heating means is connected to a power supply and a switch which is on a main body of through connectors which are attached to said apparatus.

4. A toner handling apparatus as claimed in claim 1, wherein said apparatus consists of a toner collecting container for accommodating the toner collected from a photoconductive member by a cleaner.

5. A toner collecting container for accommodating the toner collected from a photoconductive member by a cleaner comprising an opening in said toner collecting container, a thermally expandable resin provided in said opening, and heating means for expanding said resin.

6. A toner collecting container as claimed in claim 5, wherein said resin expands from an original thickness to a thickness several times to several tens of times as large as the original thickness when heated to an expanding temperature and becomes adhesive upon expansion.

7. A toner collecting container as claimed in claim 5, wherein said heating means is connected to a power supply and a switch which is on a main body of a copying machine through connectors which are attached to said container.

8. A transfer-type electrophotographic copying machine comprising a toner handling apparatus having an opening therein, a thermally expandable resin provided in the opening of said apparatus, and heating means in said machine for expanding said resin.

9. A transfer-type electrophotographic copying machine as claimed in claim 8, wherein said resin expands from an original thickness to a thickness several times to several tens of times as large as the original thickness when heated to an expanding temperature and becomes adhesive upon expansion.

10. A transfer-type electrophotographic copying machine as claimed in claim 8, wherein said heating means is provided in the opening adjacent to said resin.

11. A transfer-type electrophotographic copying machine as claimed in claim 8, wherein said toner handling apparatus is a toner collecting container for accommodating the toner collected from a photoconductive member by a cleaner.

12. A toner collecting container for accommodating the toner collected from a photoconductive member by a cleaner, said container having at least one opening, and a thermally expandable resin provided in said opening, and heating means for expanding said resin.

13. A toner collecting container as claimed in claim 12, wherein said resin expands from an original thickness to a thickness several times to several tens of times as large as the original thickness when heated to an expanding temperature and becomes adhesive upon expansion.

14. A toner collecting container as claimed in claim 12, wherein said heating means is provided in said opening adjacent to said resin.

15. An image forming unit detachably mounted in a main body of a transfer-type electrophotographic copying machine, and which comprises a photoconductive member, at least one copying element disposed adjacent to the photoconductive member and adapted to accommodate a developer therein, said copying element and said photoconductive member defining an opening, a thermally expandable resin in said opening, and heating means for expanding said resin.

16. An image forming unit as claimed in claim 15, wherein said resin expands from an original thickness to a thickness several times to several tens of times as large as the original thickness when heated to an expanding temperature and becomes adhesive upon expansion.

17. An image forming unit as claimed in claim 15, wherein said heating means is provided in said opening adjacent to said resin.

18. An image forming unit as claimed in claim 15, wherein said copying element is a developing device.

19. An image forming unit as claimed in claim 15, wherein said copying element is a cleaner.

* * * * *